US005154044A

United States Patent [19]

Payen

[11] Patent Number: 5,154,044

[45] Date of Patent: Oct. 13, 1992

[54] PROCESS AND MACHINE FOR THE CONTINUOUS PRODUCTION OF AN ELASTANE-BASED ELASTIC YARN

[75] Inventor: Pierre Payen, Le Loup, 01320 - Chalamont, France

[73] Assignees: L. Payen et cie, Societe Anonyme; Pierre Payen, both of France

[21] Appl. No.: 758,350

[22] Filed: Sep. 9, 1991

Related U.S. Application Data

[63] Continuation of Ser. No. 547,764, Jul. 3, 1990, abandoned.

[30] Foreign Application Priority Data

Jul. 21, 1989 [FR] France ..... 89 10113

[51] Int. Cl.[5] ..... D02G 3/00; D02G 3/32

[52] U.S. Cl. ..... 57/58.32; 57/6; 57/282

[58] Field of Search ..... 57/6, 58.3-58.38, 57/282, 309, 310

[56] References Cited

U.S. PATENT DOCUMENTS

| | | | |
|---|---|---|---|
| 3,540,204 | 11/1970 | Tanaka et al. | 57/6 |
| 3,775,961 | 12/1973 | Womer | 57/310 |
| 3,844,103 | 10/1974 | Sasaki et al. | 57/6 X |
| 3,914,930 | 10/1975 | Jenkins | 57/6 |
| 3,921,382 | 11/1975 | Tsujita et al. | 57/6 |
| 3,983,687 | 10/1976 | Lewis | 57/309 X |
| 4,125,530 | 8/1980 | Beau et al. | 57/282 X |
| 4,215,529 | 8/1980 | Gerbracht | 57/282 X |
| 4,334,401 | 6/1982 | Bahia | 57/6 |

FOREIGN PATENT DOCUMENTS

| | | | |
|---|---|---|---|
| 200773 | 12/1954 | Australia | 57/58.3 |
| 644248 | 7/1962 | Canada | 57/58.3 |
| 2184230 | 12/1973 | France | 57/6 |
| 2561676 | 9/1985 | France . | |

*Primary Examiner*—Daniel P. Stodola
*Assistant Examiner*—William Stryjewski
*Attorney, Agent, or Firm*—Wall and Roehrig

[57] ABSTRACT

An apparatus and process for continuous production of a covered elastane-based yarn is shown in which a partially stretched multi-filament yarn is twisted about a tensioned bare elastane yarn, at less than 500 revolutions per meter, and then heated and stretched again to complete the residual stretching of both parts of the covered yarn.

5 Claims, 1 Drawing Sheet

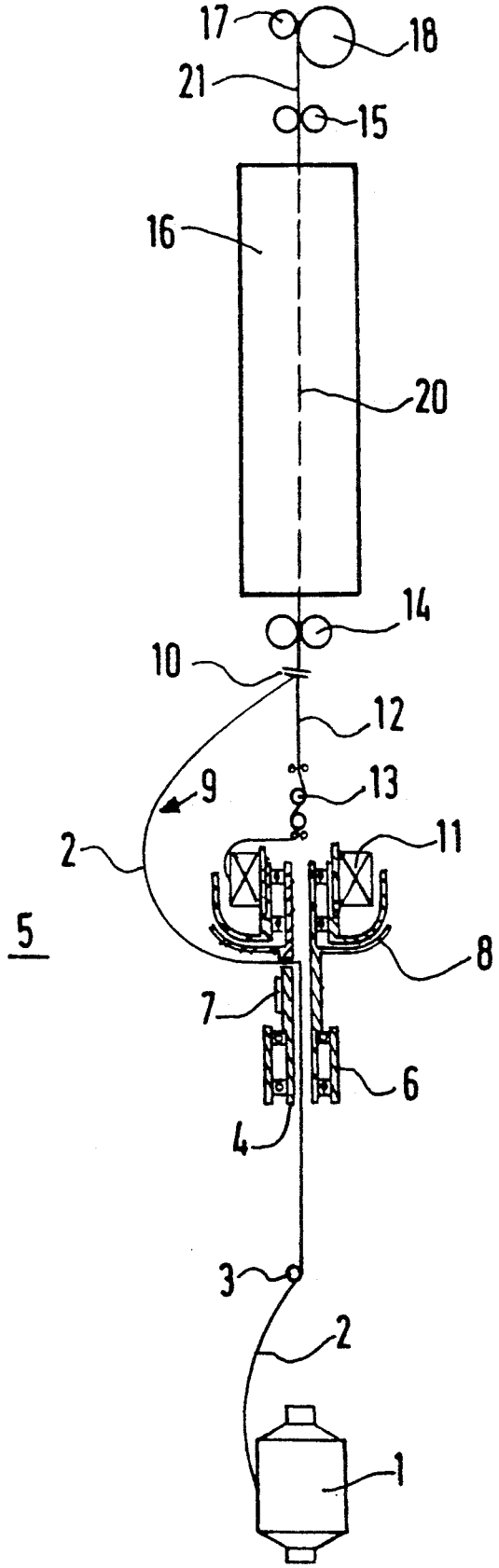
17
18
21
15
16
20
14
10
12
9
13
2
11
5
8
7
6
4
3
2
1

PROCESS AND MACHINE FOR THE CONTINUOUS PRODUCTION OF AN ELASTANE-BASED ELASTIC YARN

This is a continuation of copending application Ser. No. 07/547,764filed on Jul. 3, 1990, now abandoned.

The invention relates to a process for the continuous production of an elastane-based elastic yarn. It also relates to a machine for carrying out this process.

BACKGROUND OF THE INVENTION

It has been known for a very long time to produce covered elastic yarns, particularly by the so-called "single-covering" technique. For this purpose, the elastane yarn is first stretched by three to five times, and then a so-called "covering" yarn, especially a textured yarn, is wound round this in preferably contiguous coils. In practice, the covering twist, which varies as an inverse function of the count of the covering yarn, is of the order of one thousand to three thousand revolutions per meter, since it is desirable to obtain substantially contiguous coils. Thus, when the finest possible single-covered yarns with a minimum of swelling are to be produced, for instance the yarns required for the production of stocking legs, it is customary to use elastane yarns which are relatively fine, that is to say of the order of ten to forty decitex hereinafter dtex, and which are covered with a synthetic yarn, raw or textured by false twist, of ten to thirty dtex, covered at twists of the order of one thousand five hundred revolutions per meter. Although this technique is in very widespread use, it nevertheless has some appreciable disadvantages, such as the high cost price and the impossibility or difficulty of obtaining windings without a knot of considerable weight.

The document FR-B-2,561,676 of the Applicants provided a technique which involves covering the tensioned elastane yarn with a partially stretched multifilament filament synthetic yarn at a covering twist of one third of the usual twist, then, in a separate phase, completing this twist by means of a double-twist spindle, and finally, in a likewise separate third phase, subjecting the covered yarn to additional residual hot stretching. This technique gives covered yarns suitable for the production of stockings and tights for which the finest possible yarns are sought. However, to obtain a correct covering of the elastane yarn and thereby protect it against unravelling, the yarn has to be twisted at twists of the order of two thousand revolutions per meter. The result is that this technique, although well developed, still remains costly.

It has also been proposed to knit or weave bare tensioned elastane yarns. This technique, although available for a long time, has not undergone further development because of the excessively high production cost resulting particularly from the high percentage of finished products such as panties of second quality.

SUMMARY OF THE INVENTION

The invention overcomes these disadvantages. It is concerned with a process and a machine for the continuous production of a single covered elastane yarn at a single work station, which is rapid and economical and which makes it possible to lower the quantity of elastane yarns and therefore the price of this yarn considerably, whilst at the same time increasing the fineness of the yarns so produced, this fineness being increasingly sought after, especially in the production of stockings and tights. Moreover, this improved technique makes it possible to use yarns so produced at knitting speeds incomparably higher than that employed with bare yarns.

This improved process for the production of an elastic yarn is characterized in that it involves continuously and at the same work station:

in a first step, single covering, at a twist of below five hundred revolutions per meter, without a twist resultant, a tensioned bare elastane yarn with a partially stretched multifilament synthetic yarn;

then, in a second step, subjecting this single covered yarn to additional hot stretching to complete the residual stretching of the partially stretched multifilament yarn, on the one hand, and of the tensioned elastane yarn, on the other hand;

and finally, winding up the elastic yarn obtained.

As is known, a "partially stretched multifilament synthetic yarn" is a synthetic yarn which has undergone only partial stretching, that is to say only a partial molecular orientation. Such yarns are well known and are commonly called "POY", pre-oriented yarn or sometimes MOY, medium-oriented yarn. Such yarns are described particularly in the document FR-A-2,151,896 or in its corresponding American documents U.S. Pat. Nos. 3,771,162 and 3,772,872 of E.I. DUPONT DE NEMOURS.

A yarn "without any twist resultant" denotes a single covered yarn, each yarn of which would have a zero twist if the other yarn were removed.

In practice:

the single covering yarn is a partially stretched polyamide yarn having a residual stretching ratio of the order of 10 to 25%;

the elastane yarn is stretched in a ratio of three.

It is important that the single covering twist of the first step be below five hundred revolutions per meter. In fact, if covering is carried out at higher twists, on the one hand the cost price is needlessly increased without any proportional improvement, and on the other hand, above all, the appearance of the finished products such as panties is affected. Advantageously, this twist for fine yarns intended for the production of stockings and panties, that is to say those in which an elastane yarn of the order of twenty dtex is used, must be between one hundred fifty and three hundred revolutions per meter, advantageously in the neighborhood of two hundred fifty revolutions per meter.

The invention also relates to a machine for the production of such an elastic yarn. This machine, consisting of a plurality of work stations, is characterized in that each station comprises:

a hollow spindle having a rotating plate and intended for receiving a stationary package of elastane yarn immobilized during the rotation of the plate;

a means for feeding a partially stretched multifilament yarn from a package to the rotating plate of the hollow spindle;

a means for stretching the elastane yarn;

a means for wrapping the stretched elastane yarn with the tensioned multi-filament yarn without any twist resultant;

a drawing means for stretching the covered yarn formed, to complete the residual stretching of the multifilament yarn and of the tensioned elastane yarn, consisting of two pairs of respective feed and stretching rollers;

a heating member arranged between the two pairs of rollers;

a member for winding up the elastic yarn formed.

It is essential that the stretching of the single covered yarn should be carried out hot, in order both to assist the residual stretching of the multifilament yarn and also to increase the elongation capacity of the elastane core yarn.

The document FR-A-2,184,230 of one of the Applicants describes a process for the single covering of a tensioned elastane yarn by winding a coating yarn helically at the moment of locking of the false twist, particularly with the use of a hollow spindle having a rotating plate, on which the elastane package is immobilized, and then thermal treatment, if appropriate continuously. Here, a standard, that is to say fully stretched multifilament yarn is used, and the covered yarn obtained has a poor covering by the covering yarn. This is why this technique has not in fact been developed further.

It was not obvious to bring together and then adapt the teachings of these two techniques described in the documents mentioned above, this being proved by the long period of time which has elapsed, given that because the first technique, not utilized, was concerned with a continuous process, whereas the second, utilized, was aimed at a discontinuous process. Furthermore, above all, bringing these two techniques together, but at the same time adapting them, makes it possible to deal successfully with a problem which had been posed for a very long time, namely obtaining the finest possible single covered elastic yarn capable of being knitted at high speed. Moreover, surprisingly, the invention makes it possible, for the same result, that is to say for the same textile qualities, to reduce the quantity of elastane yarn and therefore the effect of this expensive raw material on the cost price of the finished yarn. Thus, the yarns produced according to the invention can be used successfully in the production of panties or stockings for which the highest fineness is sought.

BRIEF DESCRIPTION OF THE DRAWINGS

How the invention can be put into practice and the advantages arising from it will emerge more clearly from the following illustrative embodiment, in the light of the accompanying single FIGURE showing a characteristic work station according to the invention.

DESCRIPTION OF A PREFERRED EMBODIMENT

Unwound from a spinning bobbin 1 is a 6.6 POY pre-oriented yarn polyamide yarn 2 having a count of seventeen dtex and formed from six parallel elementary filaments. After additional stretching, this POY yarn 2 makes it possible to obtain a standard six-strand fourteen dtex yarn.

This coating yarn 2 subsequently passes through a tension device 3 and then enters the hollow axle 4 of a hollow spindle, designated by the general reference 5, which is carried by a bearing 6 and which is driven tangentially by a belt 7. In a known way, the bearing 6 can be disengaged by moving the belt 7 away. The partially stretched single covering yarn 2 passes through the axle of the spindle 4, enters the rotating plate 8 tangentially and forms a balloon 9 limited by the balloon stop lappet 10.

The spindle 5 carries a package 11 of elastane yarn 12, for example a yarn marketed by E.I. DUPONT DE NEMOURS under the registered trademark LYCRA, of twenty-two dtex either monofilament or multifilament. During the rotation of the rotating plate 8, this package 11 is stationary. The elastane yarn 12 is highly tensioned as result of the braking which the tension device exerts on it, whilst it is drawn upwards by the positive feed of the first feed roller 14 of the drawing means. The elastane yarn 12 thus elongated enters the lappet 10, where it is wrapped with the yarn 2, with a false-twist effect, but without any twist resultant. The wrapped yarn 20 obtained subsequently enters a drawing means formed by two pairs of respective feed 14 and stretching 15 rollers or capstans, in order to undergo an additional stretching intended for completing the residual stretching of the partially stretched multifilament yarn 2, on the one hand, and of the tensioned elastane yarn 12, on the other hand.

To make it easier to obtain this stretching and the elongation properties of the finished yarn, this additional characteristic stretching is carried out hot, that is to say by passage through a known thermal heater 16.

The finished wrapped elastic yarn 21 is wound up by a known means 17 in the form of a reel 18. In a practical embodiment, the covering yarn 2 is a 6.6 seventeen dtex six-strand polyamide POY yarn which, after stretching, is capable of forming a standard fourteen dtex six-strand yarn. The elastane core yarn 12 is a LYCRA yarn, registered trademark of E.I. DUPONT DE NEMOURS, of twenty-two dtex which, after passing through the tension device 13, is stretched by approximately three times in order to be brought to seven dtex. The speed ratio between the two capstans 14 and 15 is set at approximately 20% and the temperature of the heater 16 at 160° C.

There is thus obtained a single covered elastic yarn 21 consisting of a substantially rectilinear elastane yarn of approximately six dtex, covered uniformly, but not contiguously with turns of 6.6 fourteen dtex six-filaments polyamide. The final count of this yarn 21 is twenty dtex, this hitherto being very difficult to obtain economically. This yarn is perfectly suitable for the production of stockings and panties on high-speed knitting machines.

I claim:

1. A process of producing at a single work station, a continuous wrapped elastic yarn suitable for use in the manufacture of fine hosiery that includes the steps of:

feeding a bare elastane core yarn from a supply means, stretching the core yarn to approximately three times its original length;

wrapping the stretched core yarn with a partially stretched pre-oriented synthetic cover yarn so that the turns of the wrap are in non-contiguous relationship and the core yarn and the cover yarn are each in an untwisted condition;

drawing the wrapped yarn between two spaced apart sets of rollers operating at different speeds to complete the stretching of both the core yarn and the cover yarn while simultaneously heating the wrapped yarn whereby the elongated capacity of the core yarn is increased; and winding the drawn wrapped yarn onto a take up.

2. The process of claim 11 wherein the core yarn has a count of approximately twenty dtex and the cover yarn is a multifilament polyamide yarn having parallel filaments and has a count of approximately seventeen dtex.

3. The process of claim 2 wherein the cover yarn is wrapped about the core yarn at between 150 and 300 turns per meter prior to drawing of the wrapped yarn.

4. The process of claim 3 wherein the speed of one set of said two spaced apart sets of rollers is 20% less than the speed of the other set of rollers.

5. The process of claim 2 wherein the residual stretching ratio of the cover yarn is between 10% and 25%.

* * * * *